US011085720B2

(12) United States Patent
Nguyen

(10) Patent No.: US 11,085,720 B2
(45) Date of Patent: Aug. 10, 2021

(54) SAFETY SELECTOR ASSEMBLY AND ASSOCIATED ACCESSORIES

(71) Applicant: Fortis Manufacturing, Inc., Kent, WA (US)

(72) Inventor: Thang V. Nguyen, Gilbert, AZ (US)

(73) Assignee: Fortis Manufacturing, Inc., Kent, WA (US)

( * ) Notice: Subject to any disclaimer, the term of this patent is extended or adjusted under 35 U.S.C. 154(b) by 0 days.

(21) Appl. No.: 16/519,954

(22) Filed: Jul. 23, 2019

(65) Prior Publication Data

US 2020/0033088 A1 Jan. 30, 2020

Related U.S. Application Data

(60) Provisional application No. 62/703,246, filed on Jul. 25, 2018.

(51) Int. Cl.
*F41A 17/46* (2006.01)
*F41A 17/52* (2006.01)

(52) U.S. Cl.
CPC ..... *F41A 17/46* (2013.01); *F41A 17/52* (2013.01)

(58) Field of Classification Search
CPC ..... F41A 17/46; F41A 17/52; F41A 17/62; F41A 17/70; F41A 17/80; F41A 17/28; F41A 17/26; F41A 17/24; F16D 49/22
USPC ..... 89/142, 148
See application file for complete search history.

(56) References Cited

U.S. PATENT DOCUMENTS

| | | | | |
|---|---|---|---|---|
| 3,442,173 | A * | 5/1969 | Muller | F41A 19/46 89/127 |
| 10,126,081 | B1 * | 11/2018 | Geissele | F41A 19/46 |
| 2017/0176122 | A1 * | 6/2017 | Underwood | F41A 11/00 |
| 2017/0299309 | A1 * | 10/2017 | Fellows | F41A 17/46 |
| 2018/0100712 | A1 * | 4/2018 | Tompkins | F41A 11/00 |

FOREIGN PATENT DOCUMENTS

DE 1034513 * 7/1958

* cited by examiner

*Primary Examiner* — Stephen Johnson
(74) *Attorney, Agent, or Firm* — Eversheds Sutherland (US) LLP

(57) ABSTRACT

A safety selector assembly for a firearm is provided. The safety selector assembly can include a core member and one or more levers removably coupled to the core member. The core member can include a first end and a second end. The core member can also include at least one shelf recessed into the outer surface of the core member. The core member can also include at least two throws disposed on the core member and between the shelf and the second end of the core member. Each throw can have a different angle of rotation between positions for allowing and preventing movement of a trigger assembly on the firearm. The core member can also include a first post on the first end and a second post on the second end of the core member. A lever can be rotatably coupled to each of the first and second posts.

16 Claims, 17 Drawing Sheets

SAFETY SELECTOR ASSEMBLY AND ASSOCIATED ACCESSORIES

RELATED APPLICATIONS

This application claims priority under 35 U.S.C. § 119 to U.S. Provisional Patent Application No. 62/703,246 filed Jul. 25, 2018, titled "Safety Selector," the entire contents of which are hereby incorporated herein by reference for all purposes.

FIELD OF THE DISCLOSURE

The present application relates generally to firearm safety selectors, and more specifically, relates to safety selectors with multiple throws.

BACKGROUND

Safety mechanisms are essential to properly handle firearms. Safety mechanisms either directly or indirectly prevent the firearm, intentionally or unintentionally, from discharging a projectile. Typically, safety mechanisms provide one or more mechanisms to block the trigger from activating the firing pin or other discharging mechanism within the firearm. The most common safety mechanisms include manual safeties that directly isolate the trigger into a single, unmoving position. Other common types of safeties include grip safeties, trigger safeties, drop safeties, and hammer blocks. The type of safety included on a firearm generally depends on the type of firearm. No matter the type of safety, one or more safety mechanisms on a firearm can help to ensure accidental discharges are a rare occurrence. Therefore, having easy access to the safety mechanism on a firearm is an absolute must.

BRIEF DESCRIPTION OF THE DRAWINGS

The detailed description is set forth with reference to the accompanying drawings. The use of the same reference numerals may indicate similar or identical items. Various embodiments may utilize elements and/or components other than those illustrated in the drawings, and some elements and/or components may not be present in various embodiments. Elements and/or components in the figures are not necessarily drawn to scale. Throughout this disclosure, depending on the context, singular and plural terminology may be used interchangeably.

DETAILED DESCRIPTION

The present disclosure provides for a safety selector assembly for a firearm. The safety selector assembly is an operable mechanism within a firearm that rotates between a first position (e.g., an engaged or safe position) and a second position (e.g., a disengaged or fire position). The first and second position engage and disengage a trigger, respectively. The amount of rotation to switch between the safe position and fire position generally depends upon the length of the throw on the safety selector. In some embodiments, as disclosed herein, the safety selector provides for multiple throws of varying angles. One benefit to multiple throws on a safety selector includes providing an operator with options for quickly or slowly alternating between the safe position of the throw and the fire position of the throw.

The present disclosure also provides for operable engagement between the safety selector core member and the safety selector lever of the safety selector assembly. After installation of the safety selector assembly, the one or more levers are disposed on the exterior of a receiver of the firearm and the core member is disposed within the receiver to engage and disengage the trigger. As such, as the lever of the safety selector assembly is rotated on the exterior of the receiver, the lever exerts a moment force onto the core member of the safety selector system via the connection between the lever and the core member. The receiver can have a first receiver side, a second receiver side, and a bottom receiver side. The receiver can have a first receiver aperture that extends between the first receiver side to the second receiver side. The receiver can have a second receiver aperture that extends from the bottom receiver side. The bottom receiver side can secure a safety detent therein that engages the safety selector core. In some embodiments, the connection between the lever and the core member includes a post extending from the core member. The post is configured to engage a socket within the lever. Once the core post is properly inserted within the socket, a detent is threaded through a lever aperture to rest within a detent slot on the post. The detent locks the core member into the lever socket, and as previously mentioned, the connection is configured to permit rotation of the core member from the lever.

Figure 1A:
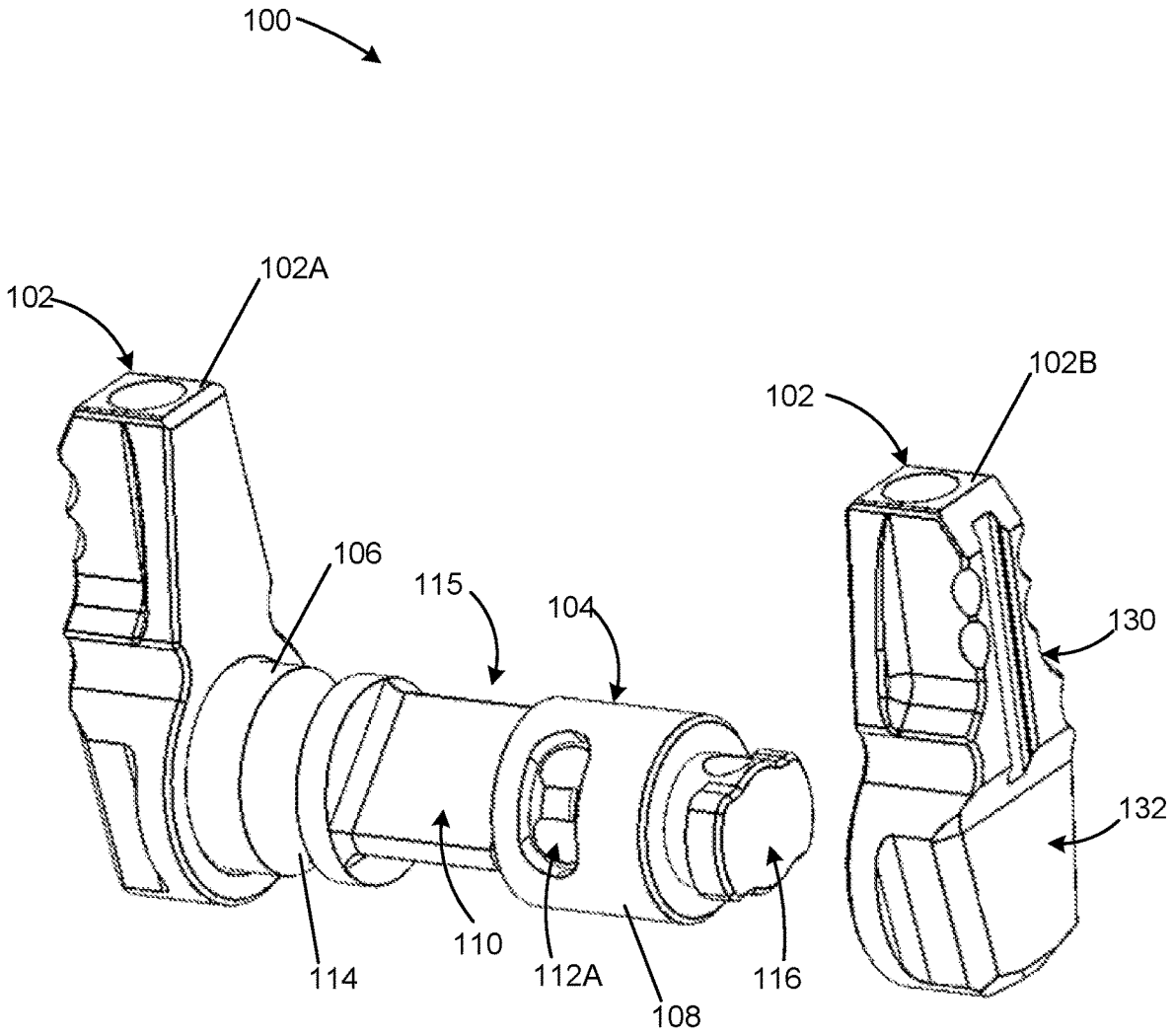
FIG. 1A is a partial-exploded perspective view of a safety selector assembly according to one or more embodiments of the disclosure.
Figure 1B:
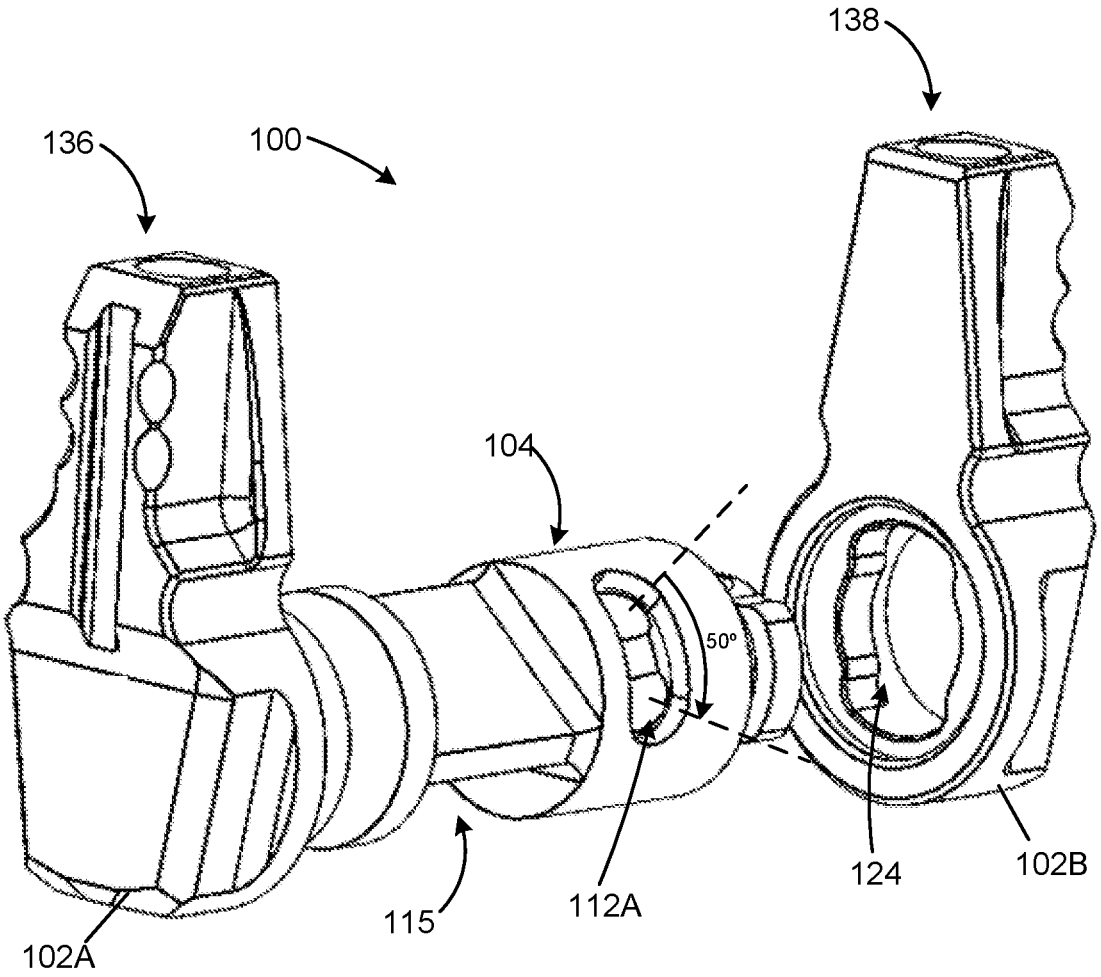
FIG. 1B is another partial-exploded perspective view of the safety selector assembly according to one or more embodiments of the disclosure.

FIG. 1A depicts a partially-exploded perspective view of a safety selector assembly 100 in accordance with one or more example embodiments of the disclosure. Referring to FIG. 1, the safety selector assembly 100 can include at least one lever 102 and a core member 104 coupled to the at least on lever 102. The core member 104 can be configured to operably engage and disengage a trigger on a firearm (not shown). As shown, the safety selector assembly 100 includes a first lever 102A, the core member 104, and a second lever 102B. The first lever 102A, the core member 104, and the second lever 102B are coupled together to operate within a firearm (not shown). The core member 104 is inserted into the firearm receiver, and the first lever 102A and the second lever 102B can be coupled to each opposing end of the core member 104. FIGS. 1A and 1B show the first lever 102A is coupled to the first end of the core member 104. It should be understood that the second lever 102B can be coupled to the second end of the core member 104.

Figure 5:
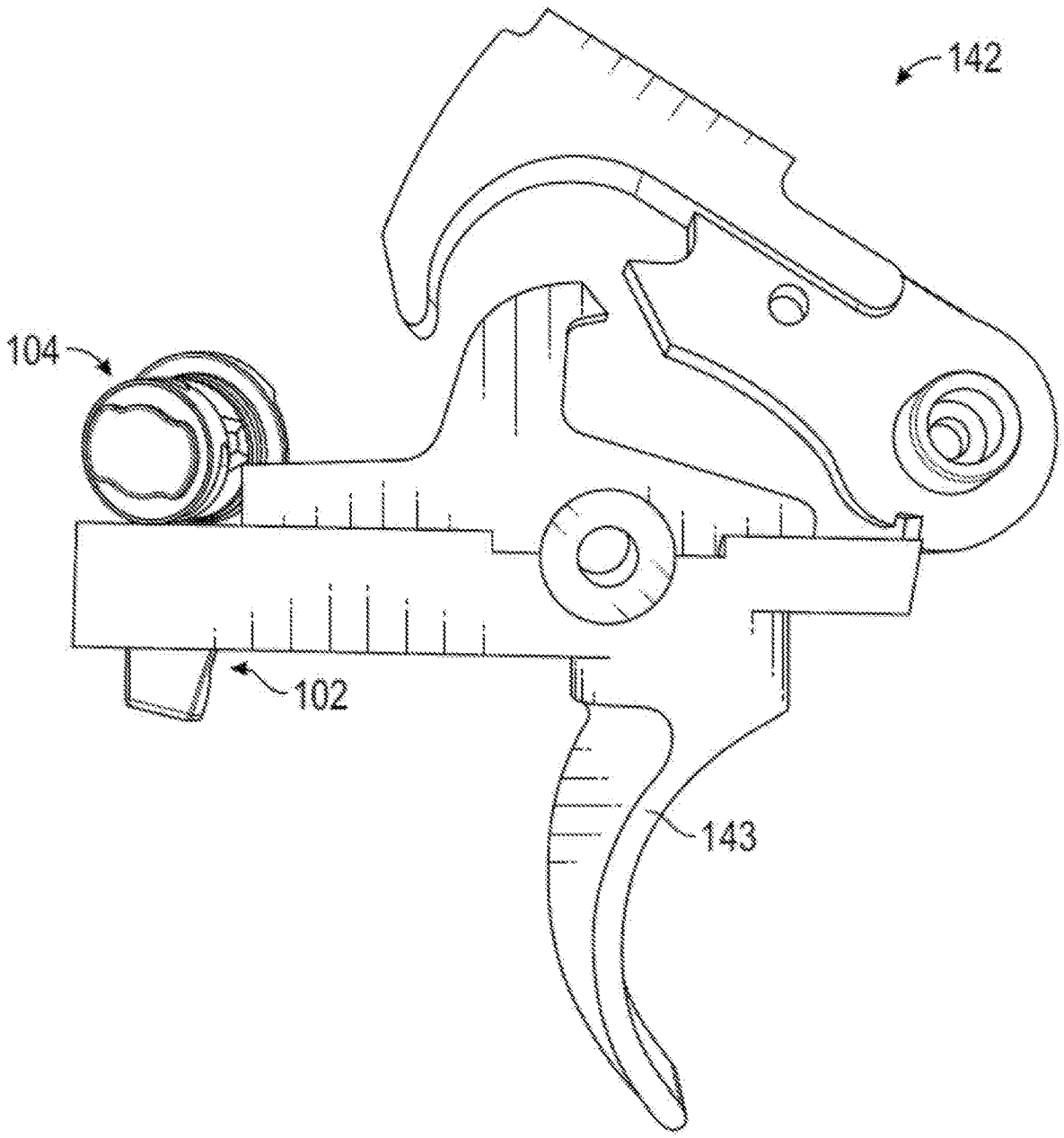
FIG. 5 is a side elevation view of the safety selector assembly and a trigger assembly according to one or more embodiments of the disclosure.
Figure 6A:
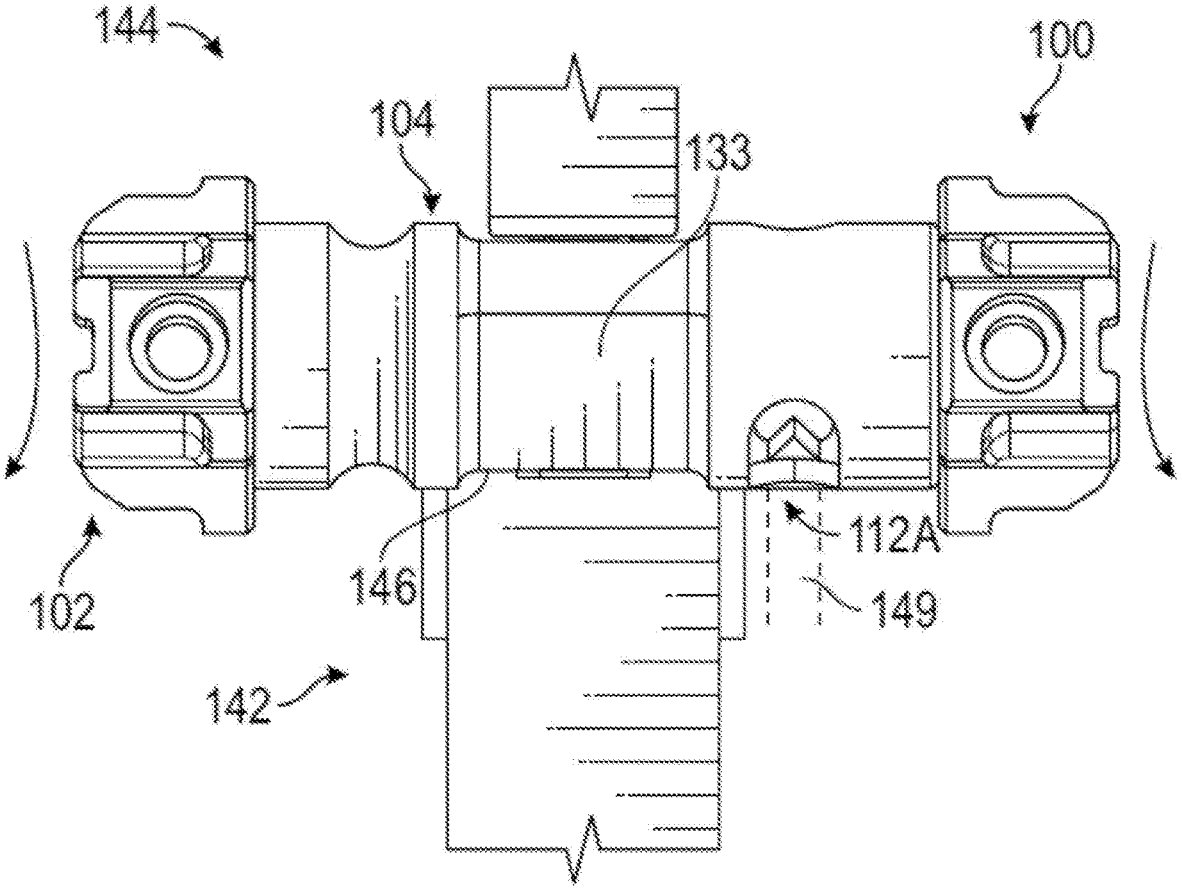
FIG. 6A is a rear view of the safety selector assembly in a safety position adjacent to the trigger assembly according to one or more embodiments of the disclosure.
Figure 6B:
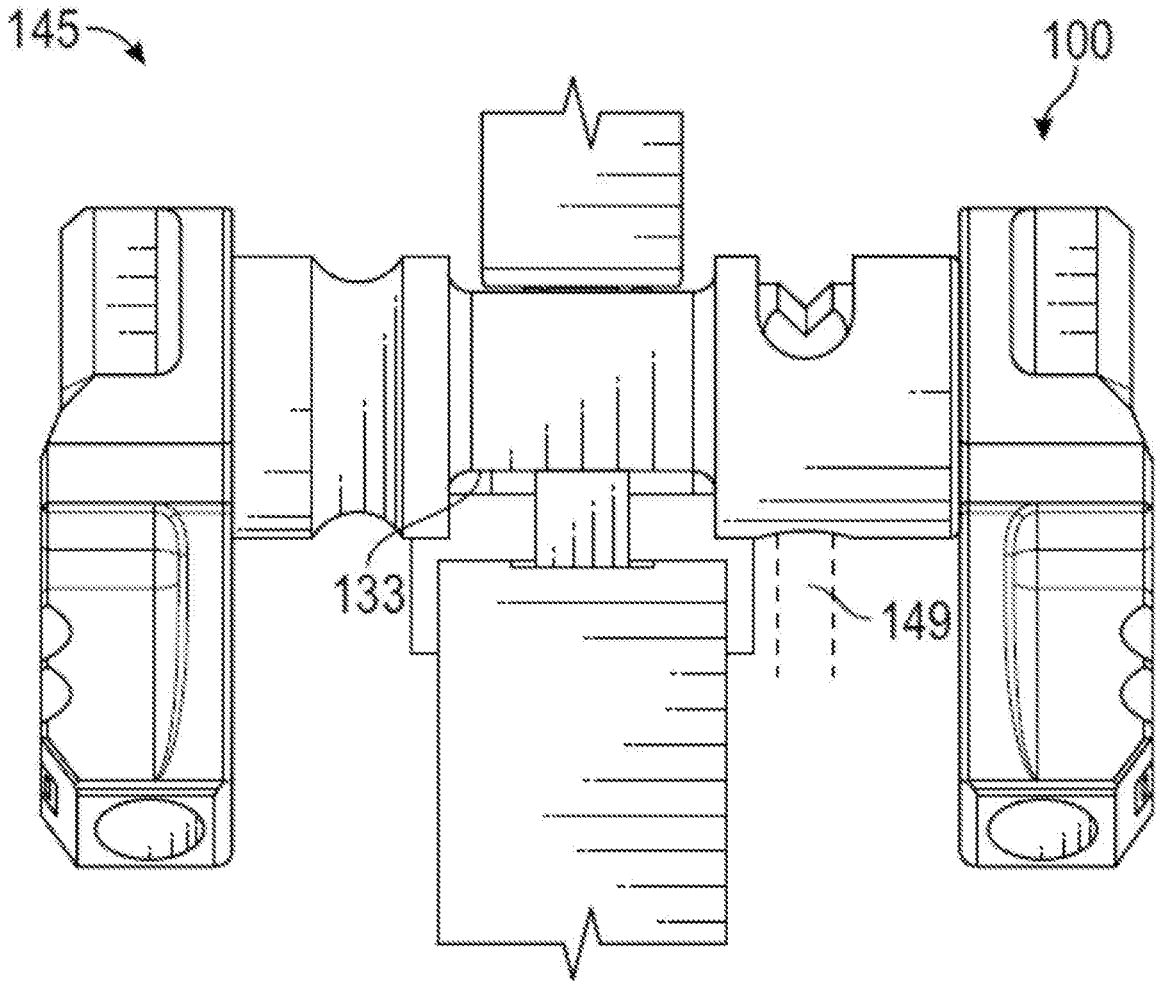
FIG. 6B is a rear view of the safety selector assembly in a fire position adjacent to the trigger assembly according to one or more embodiments of the disclosure.

In one example, to assemble the safety selector assembly 100 to a firearm, the core member 104 can be inserted through a safety slot (not shown) on the firearm receiver. Once inserted, the first lever 102A can be positioned adjacent to and/or abutting against an outside surface of the receiver. The second lever 102B can then be coupled to the second end of the core member 104 when the second end of the core member 104 protrudes out from the opposite side of the safety slot on the receiver. Together, the core member 104 rotates with the levers 102A, 102B to engage and disengage the trigger between a first position and a second position. As discussed herein, the core member 104 can rest in the first position (e.g., the safe position) by a safety detent 149 (e.g., as shown in FIGS. 6A-7B as set of dashed lines) engaging the one or more throws on the core member 104 to stop the rotation of the trigger within the trigger assembly 142 (e.g., as shown in FIG. 5). The levers 102A, 102B can be manually rotated by a user to the second position (e.g., as shown in FIG. 6B) (e.g., the fire position).

FIG. 1B depicts another partially-exploded perspective view of the safety selector assembly 100 in accordance with one or more example embodiments of the disclosure. The levers 102A, 102B of the safety selector assembly 100 can be manually rotated by a user between a locked position 136 (e.g., secured position on the core member 104), and an unlocked position 138 (e.g., unsecured position on the core member 104). In one example, the core member 104 can include a set of mounting posts 116 that extend out from each end of the core member 104. In one example, a first mounting post 116 extends out axially or substantially axially from the first end of the core member 104 and a second mounting post 116 extends out axially or substantially axially from the opposing second end of the core member 104. All or at least a portion of each post 116 can be configured to be slidably received within a socket 124 of one of the corresponding levers 102A, 102B to couple the core member 104 to the respective lever 102A, 102B, and the lever can rotate to the locked position 136 on the post 116. As shown, the second lever 102B can be in the unlocked position 138 (i.e., not secured onto the post 116). In one example, the post 116 can have a particular shape or be keyed, and each corresponding lever 102A, 102B can have a socket 124 that has a shape that corresponds with the shape or key of the post 116, such that the post 116 can only be received through the socket 124 in the lever 102A, 102B in one, two, or a particular number of orientations. Once the post 116 is aligned with the socket 124, all or at least a portion of the post can be slid into and through the socket 124. The lever 102B can then be rotated to the locked position 136 (e.g., the first lever 102A is in the locked position 136 in FIG. 1A) to couple the lever 102B to the core member 104.

FIGS. 2A-2D depict elevation views of various sides of the core member 104 of the safety selector assembly 100. Now referring to FIGS. 1A-2D, the core member 104 can include a first end 105 and a second end 107. In certain example embodiments, the core member 104 can be substantially cylindrical outer surface and extend between the first end 105 and the second end 107. The core member 104 can include a set of posts 116 that extend away from the core member 104 at each the first end 105 and the second end 107. Each of the posts 116 can include a base 109 (not shown), at least one lip 118, and a post detent slot 120. As shown, the base 109 extends outward from the respective end 105, 107 of the core member 104. The base 109 can have a generally cylindrical shape that extends along the longitudinal axis 125 of the core member 104. In addition, each post 116 can have one or more lips 118 (e.g., two lips) disposed along a free end of the base 109 and extend radially outward from the outer surface of the base 109. Each of the lips 118 can be positioned opposite to one another about the base 109 and can extend circumferentially about a portion of the base 109. Between each lip 118, each post 116 can also include a post detent slot 120 that defines an aperture extending into the base 109. The post detent slot 120 can receive and secure a detent therein.

Figure 2A:
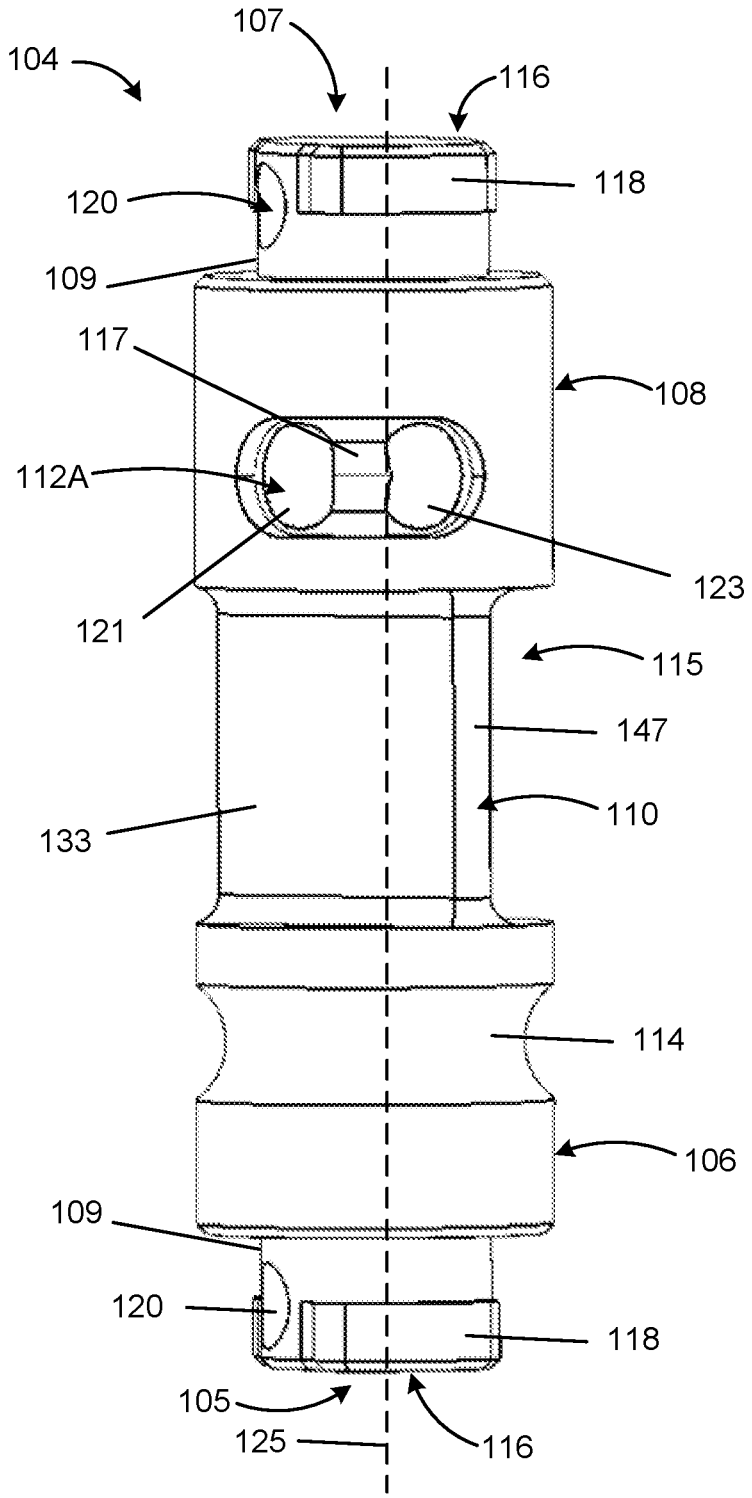
FIG. 2A is a first side elevation view of a core member of the safety selector assembly of FIG. 1A according to one or more embodiments of the disclosure.

The core member 104 can also include a first raised portion 106, a second raised portion 108, and a recessed portion 115. In some examples, the recessed portion 115 is disposed between the first raised portion 106 and the second raised portion 108 along the core member 104. In certain example embodiments, the first raised portion 106 is positioned next to the first post 116, and the second raised portion 108 is positioned next to the second post 116. In certain example embodiments, each of the first raised portion 106 and the second raised portion 108 can have a radius from the axis 125 that is greater than the radius of the base 109 of each of the posts 116 and the radius of the recessed portion 115. In one example, the first raised portion 106 can be cylindrical or substantially cylindrical. As shown, the first raised portion 106 is located adjacent to the first end 105. The second raised portion 108 can include at least two throws 112A, 112B. The at least two throws 112A, 112B can include a first throw 112A (e.g., as shown in FIGS. 1B and 2A) and a second throw 112B (e.g., as shown in 2B). In other examples, the core member 104 can include more than two throws 112. The first throw 112A can include a first throw slot 121 and a second throw slot 123 disposed circumferentially from the first throw slot 121 along the outer surface of the second raised portion 108. Each of the first throw slot 121 and the second throw slot 123 can extend radially from an outer surface of the second raised portion 108 of the core member 104. In one example, the first throw 112A and the second throw 112B can include a throw channel 117 that is recessed below the outer surface of the second raised portion 108 and extends between the first throw slot 121 and the second throw slot 123. Each throw slot 121, 123 has a greater depth into the second raised portion 108 of the core member 104 than the recessed channel. The first throw slot 121 and the second throw slot 123 can have a 50-degree angle measuring from a center axis 125 of the core member 104 to the center of each throw slot 121, 123. In other examples, the angle between the throw slots can be greater or less than 50 degrees, for example, anywhere between substantially 45 to substantially 55 degrees, substantially 40 to substantially 60 degrees, or substantially 35 to substantially 70 degrees. Similarly, the second throw 112B can include a third throw slot 127 and a fourth throw slot 129 disposed circumferentially from the third throw slot 127 along the outer surface of the second raised portion 108. Each of the third throw slot 127 and the fourth throw slot 129 can extend radially from an outer surface of the second raised portion 108 of the core member 104. In one example, the second throw 112B can include a channel between the third throw slot 127 and the fourth throw slot 129. Each throw slot has a greater depth into the core member 104 than the channel. The third throw slot 127 and the fourth throw slot 129 can have a 90-degree angle measuring from a center axis 125 of the core member 104 to the center of each throw slot 127, 129. In other examples, the angle between the throw slots 127, 129 can be greater or less than 90 degrees, for example, anywhere between substantially 85 to substantially 95 degrees, substantially 80 to substantially 100 degrees, or substantially 75 to substantially 105 degrees. In one example, the second throw is positioned circumferentially apart from the first throw about the longitudinal axis 125 of the core member 104.

Figure 7A:
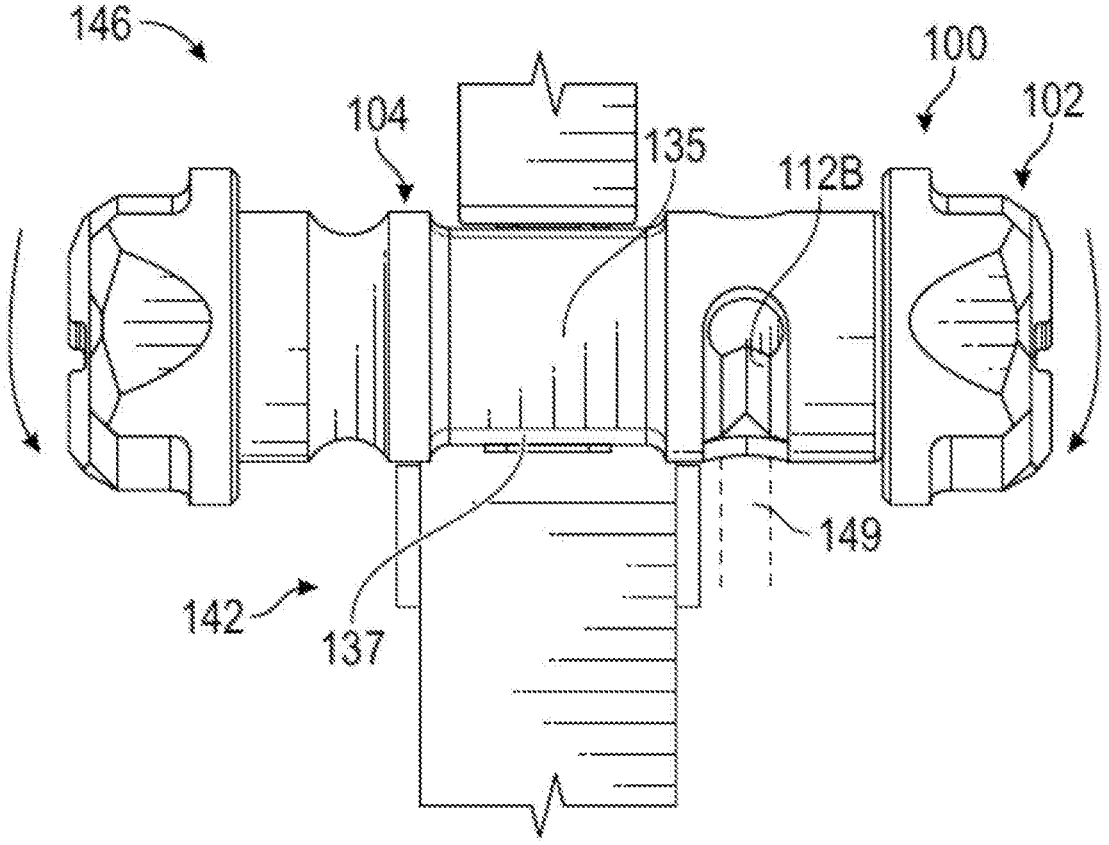
FIG. 7A is a rear view of the safety selector assembly in a safety position adjacent to the trigger assembly according to one or more embodiments of the disclosure.
Figure 7B:
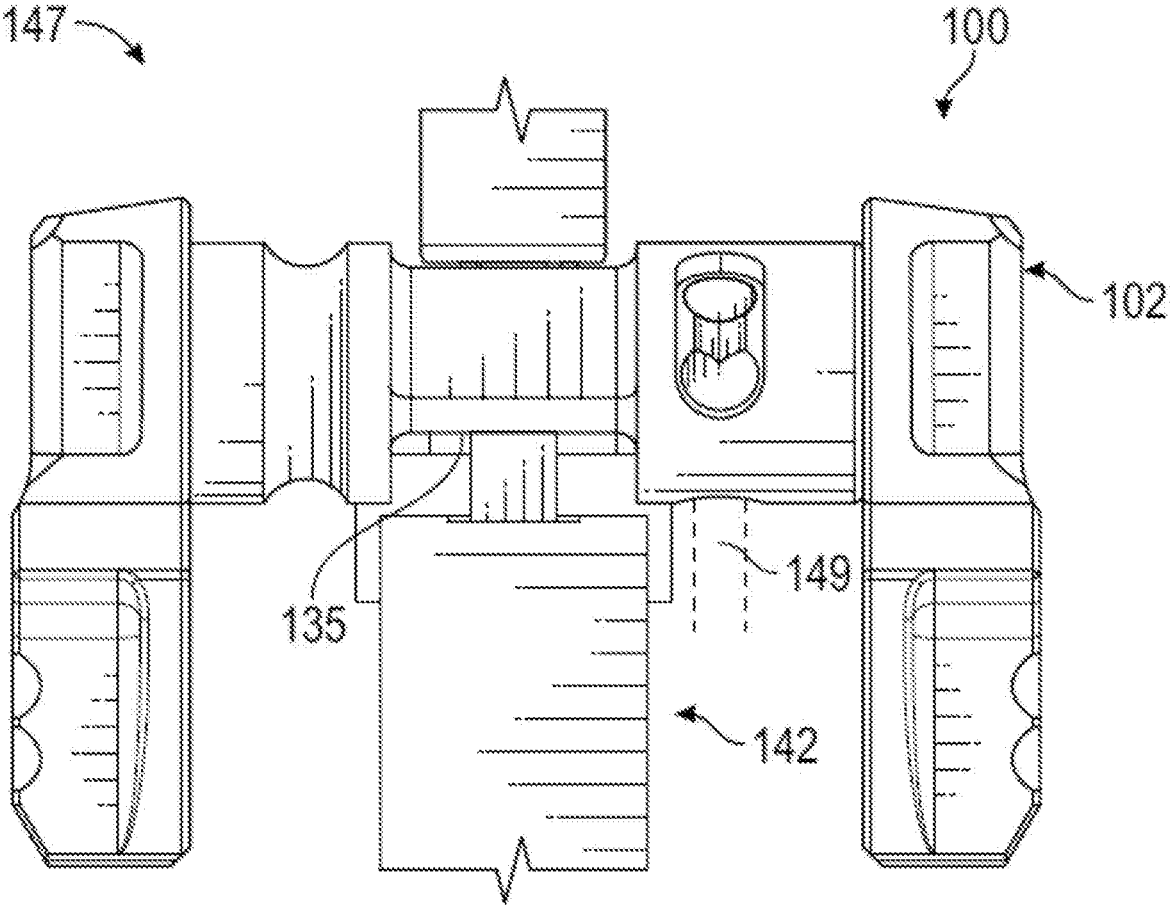
FIG. 7B is a rear view of the safety selector assembly in a fire position adjacent to the trigger assembly according to one or more embodiments of the disclosure.

The safety selector assembly 100 can be secured within a firearm receiver (not shown). In some examples, the firearm receiver includes a safety detent 149 (e.g., as shown in FIGS. 6A-7B as a set of dashed lines) that abuts the safety selector assembly 100. The safety detent 149 can ride within each of the throws described herein, adjusting the firearm between the safety position and the firing position. The safety detent 149 can abut the safety selector assembly 100 when the core member 104 is in the first position 144 (as shown in FIG. 6A), second position 145 (as shown in FIG. 6B), third position 146 (as shown in FIG. 7A), or fourth position 147 (as shown in FIG. 7B). When the core member 104 is in the first position 144, the safety detent 149 of the firearm receiver is engaged within the first throw slot 121. The core member 104 can be adjusted to the second position 145 by rotating the core member 104 with one of the levers 102A, 102B. As the core member 104 of the safety selector assembly 100 rotates with respect to the firearm receiver, the safety detent 149 leaves the first throw slot 121, rides along the throw channel 117, and engages the second throw slot 123 to reach the second position for the core member 104. The safety detent 149 can be a biasing member and as the safety selector assembly begins to rotate, the force from the throw slots can depress the safety detent 149 to ride within the channel to another throw slot. In some examples, the safety selector assembly 100 can be rotated to where the safety detent 149 engages the third throw slot 127 of the second throw 112B when the core member 104 is in the third position 146. The core member 104 can also be adjusted from the third position 146 to the fourth position 147 by rotating the core member 104 with one of the levers 102A, 102B. As the core member 104 of the safety selector assembly 100 rotates with respect to the firearm receiver, the safety detent 149 leaves the third throw slot 127, rides along the throw channel 117, and engages the fourth throw slot 129 in the fourth position.

The second raised portion 108 of the core member 104 can include a groove 114. In some examples, the groove 114 is disposed in the outer surface of and extends about the circumference of the second raised portion 108. The groove 114 can be an arcuate channel embedded into the outer surface of the second raised portion 108. In other example embodiments, the groove 114 may be any other shape and can extend in any other manner about the outer surface of the core member 104.

Figure 2B:
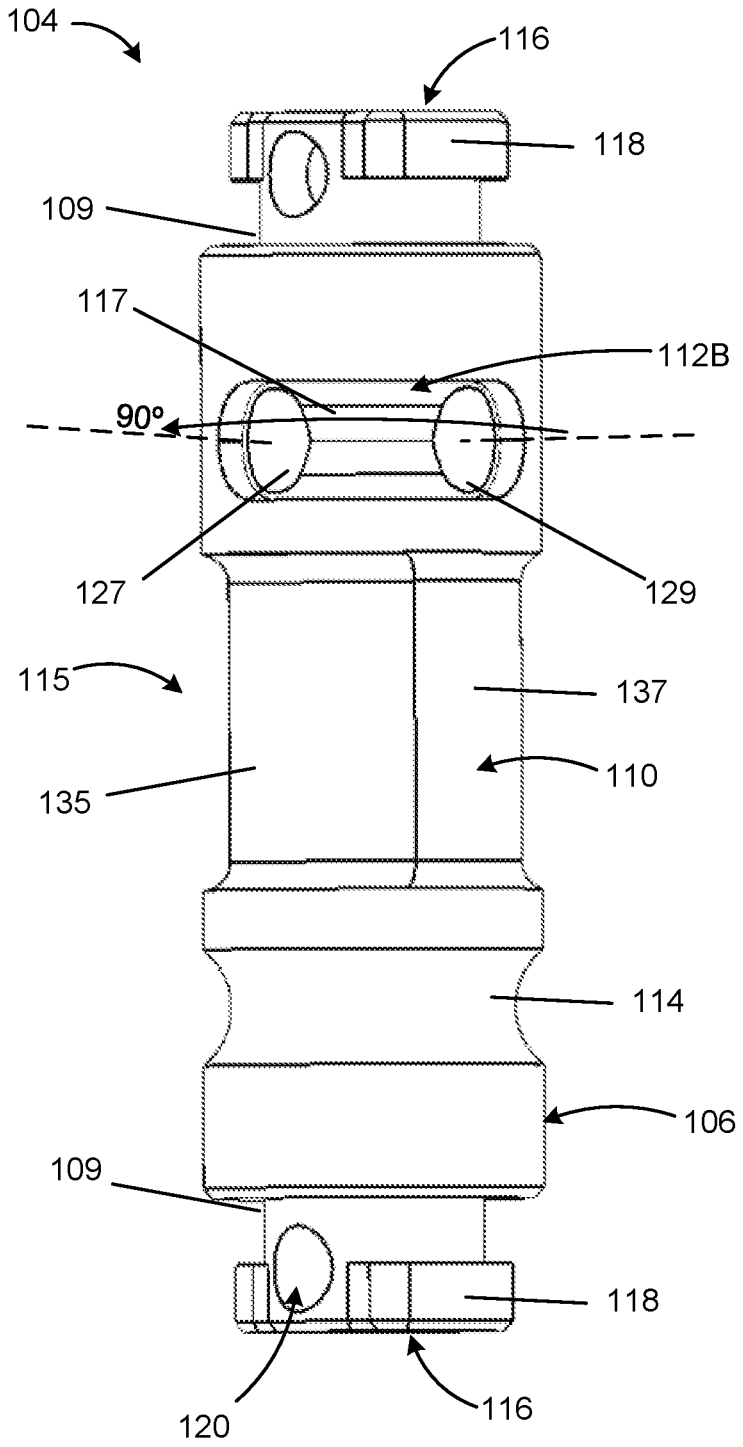
FIG. 2B is a second side elevation view of the core member of the safety selector assembly according to one or more embodiments of the disclosure.
Figure 2C:
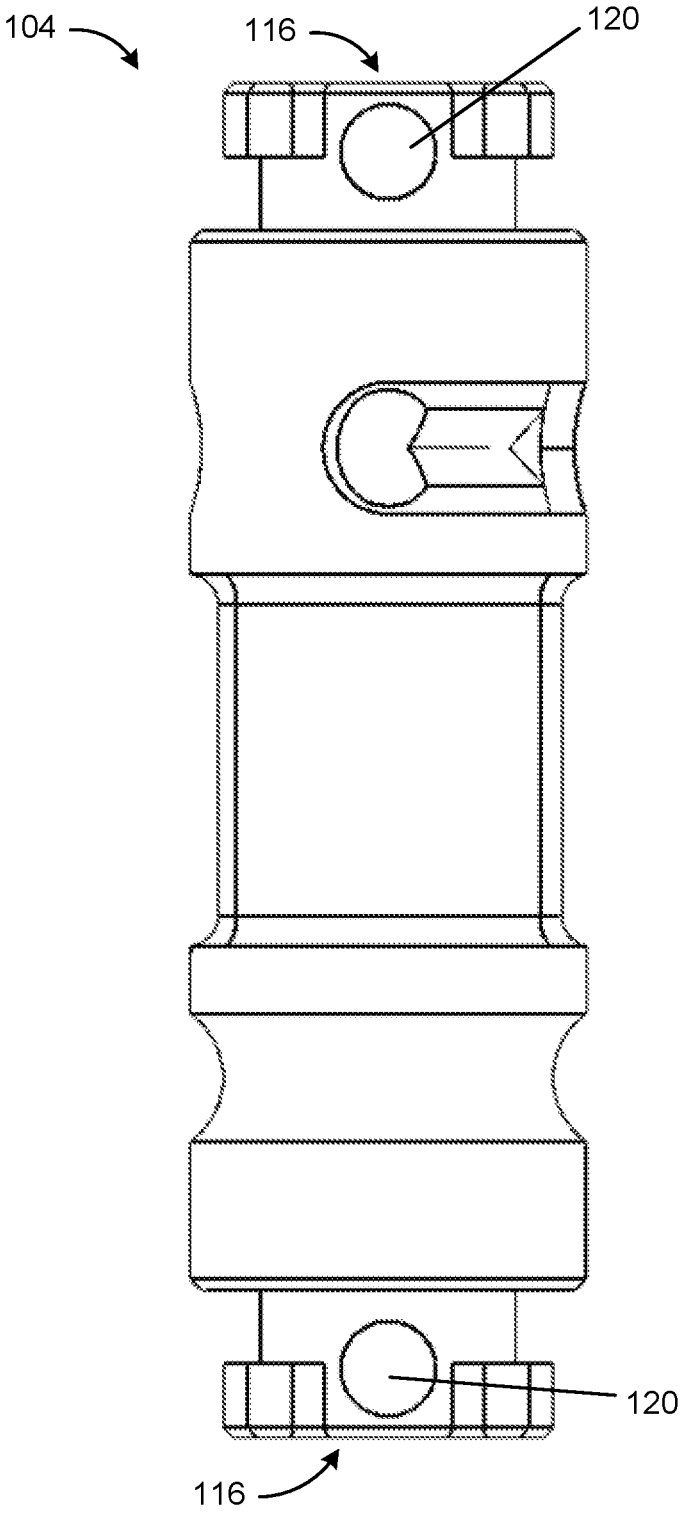
FIG. 2C is a third side elevation view of the core member of the safety selector assembly according to one or more embodiments of the disclosure.
Figure 2D:
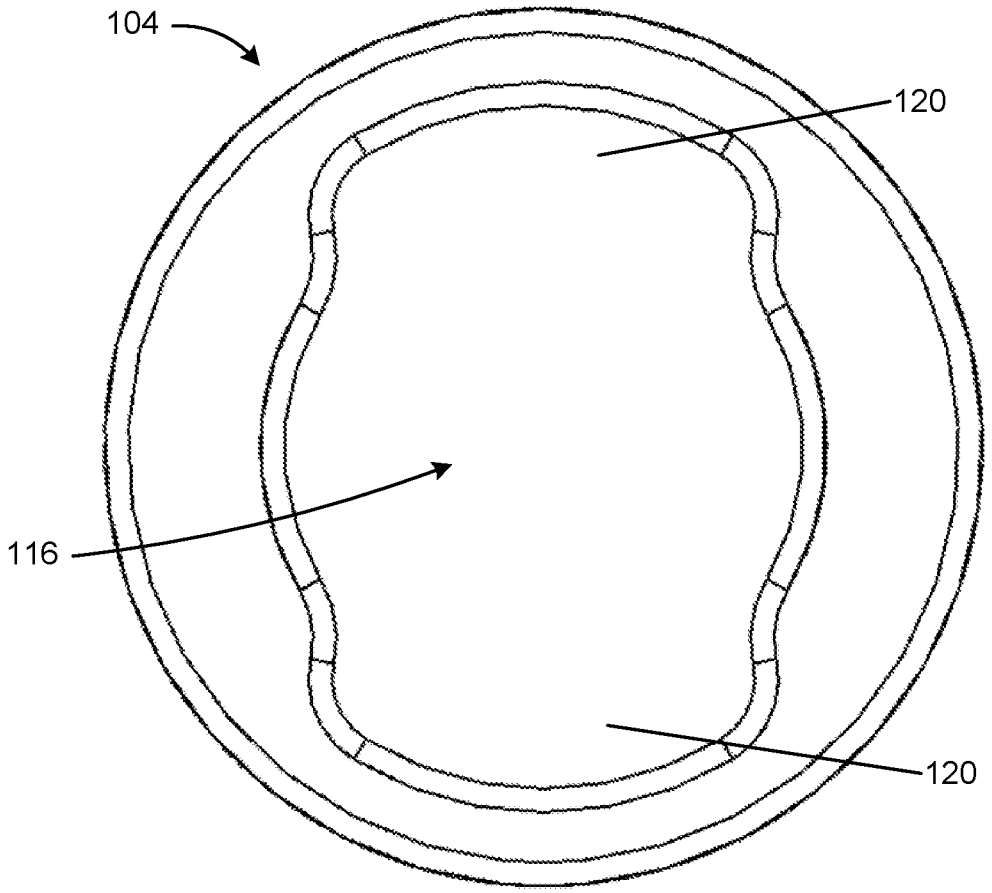
FIG. 2D is a top plan view of the core member of the safety selector assembly according to one or more embodiments of the disclosure.

Between the first raised portion 106 and the second raised portion 108, the safety selector assembly 100 can include the recessed portion 115. The outer surface of the recessed portion 115 can have a maximum diameter that is less than the maximum diameter for each of the first raised portion 106 and the second raised portion 108. The recessed portion 115 can include at least one shelf 110. In one example, the shelf 110 is a planar or substantially planar surface. In some examples, the shelf 110 can abut components (e.g., trigger, trigger bar, etc.) within the firearm receiver to prevent movement of the trigger assembly 142 (e.g., as shown in FIG. 5). For example, at least one of the shelf surfaces can prevent rotation of a trigger 143 within the trigger assembly 142 by abutting the trigger assembly. In some examples, the safety selector assembly 100 is secured into a position by the safety detent 149 (not shown) extending through the firearm receiver and engaging the throw slot corresponding with the position of the shelf surface abutting the trigger assembly 142. The safety selector assembly is 100 is secured into place abutting the trigger assembly to prevent rotation. As shown in FIGS. 2A and 2B, the shelf 110 can include a first shelf surface 133, a second shelf surface 135, a third shelf surface 137, and a fourth shelf surface 147. The first shelf surface 133 and the shelf second surface 135 be adjacent with the first throw 112A and the second throw 112B, respectively. In some examples, the shelf surfaces 133, 135 align with the respective throw 112A, 112B to ensure proper engagement (e.g., contact) with the trigger assembly to prevent trigger movement. That is, the first throw 112A is adjacent with the first shelf surface 133 and a fourth shelf surface 147. When the first shelf surface 133 is adjacent with a trigger assembly (e.g., as shown in FIG. 6A), the trigger assembly can rotate. The fourth shelf surface 147 can abut the trigger assembly when the safety selector assembly 100 is rotated along the first throw 112A. The second throw 112B can align with the second shelf surface 135 and the third shelf surface 137 to abut the trigger assembly in one of the two positions (e.g., the third position or the fourth position). When the second shelf surface 135 is adjacent with the trigger assembly, the trigger assembly can rotate. The third shelf surface 137 can abut the trigger assembly when the safety selector assembly 100 is rotated along the second throw 112B. The third shelf surface 137 and fourth shelf surface 147 each extend between the first shelf surface 133 and the second shelf surface 135 on opposing sides. The third shelf surface 137 and fourth shelf surface 147 can be arcuate. In other examples, the surfaces 133, 135, 137, 139 may all be flat or substantially flat.

FIGS. 3A-3E depict various views of the lever 102 of the safety selector assembly 100. The lever 102 can include a lever head 132 and a lever handle 130. The lever head 132 can receive one of the posts 116 to secure the lever 102 onto the core member 104. In some examples, the lever head 132 includes a socket 124 or recessed opening to receive one of the posts 116 of the core member 104. The socket 124 can receive the post 116 by each lip 118 and/or other portion of the post 116 aligning with the complementary shape of a rim 126 of the socket 124 on the lever head 132. The rim 126 can be defined by an embedded recessed portion 128 of the socket 124 within the lever head 132. The socket 124 is an open volume etched within the lever head 132 and is partially bounded by the rim 126 to secure the core member 104 to the lever 102. All or at least a portion of the post 116 can be slidably inserted into the socket 124. One of the core member 104 and the lever 102 can then be turned 90 degrees to couple the core member 104 to the lever 102. In the coupled position, the at least a portion of the lips 118 of the post 116 are positioned between a socket floor 140 and the rim 126 of the embedded recessed portion 128. In other examples, the post 116 may turn more or less than 90 degrees to couple the core member 104 to the lever 102 and to position the one or more lips 118 under the embedded recessed portion 128.

Figure 3A:
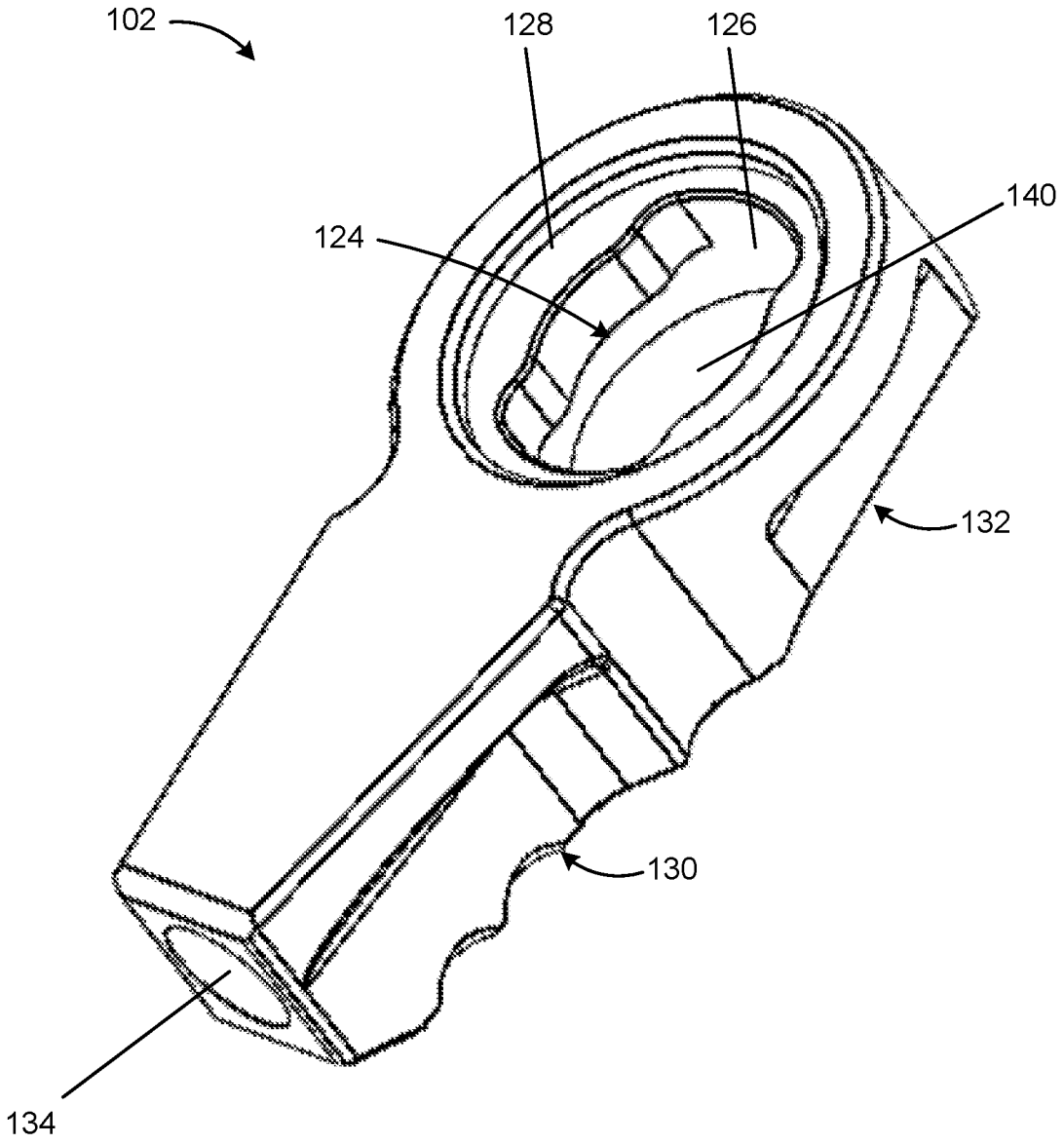
FIG. 3A is a perspective view of the lever of the safety selector assembly according to one or more embodiments of the disclosure.
Figure 3B:
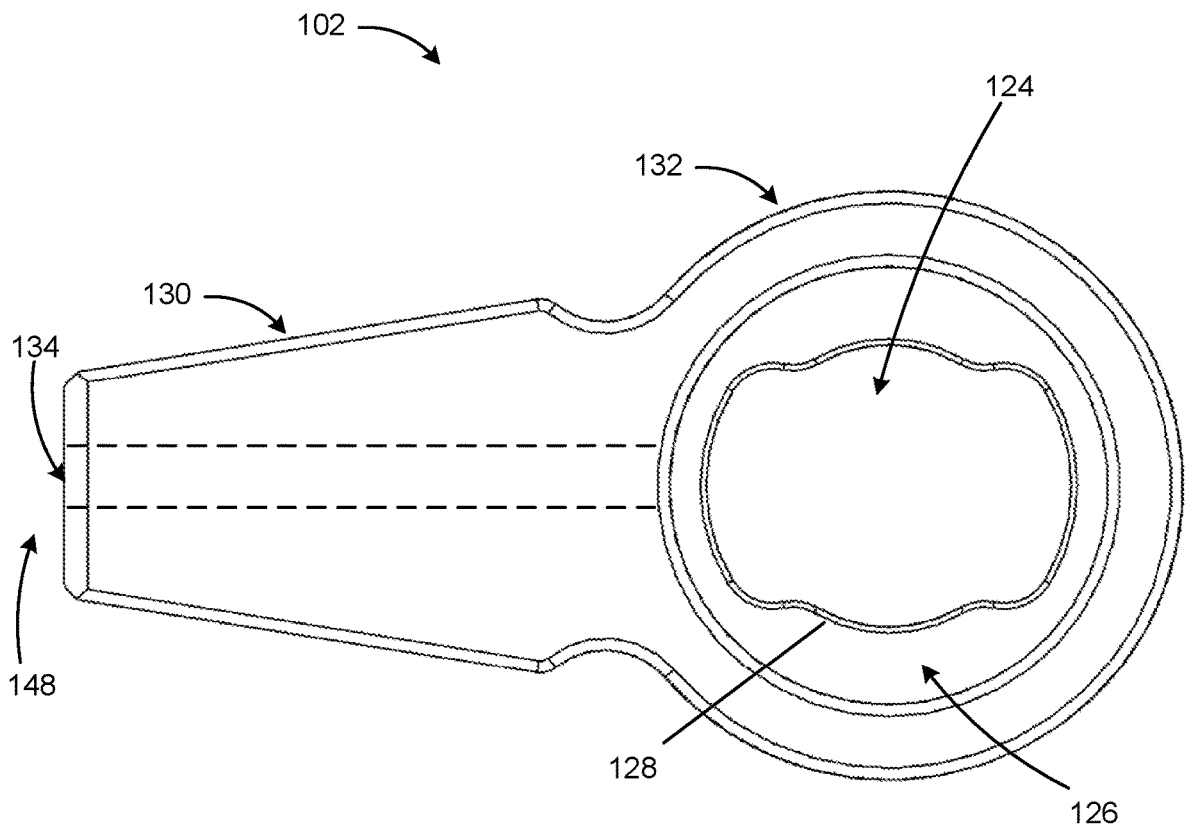
FIG. 3B is a bottom plan view of a lever of the safety selector assembly of FIG. 1A according to one or more embodiments of the disclosure.
Figure 3C:
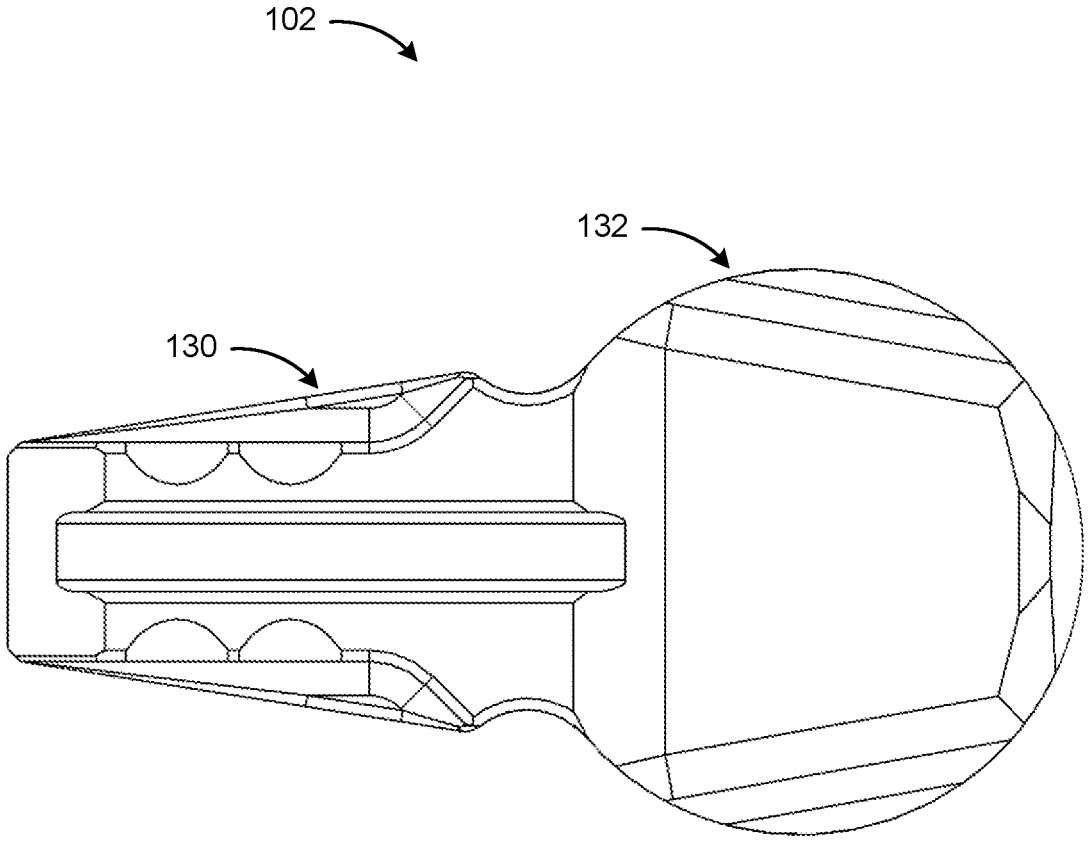
FIG. 3C is a top plan view of the lever of the safety selector assembly according to one or more embodiments of the disclosure.
Figure 3D:
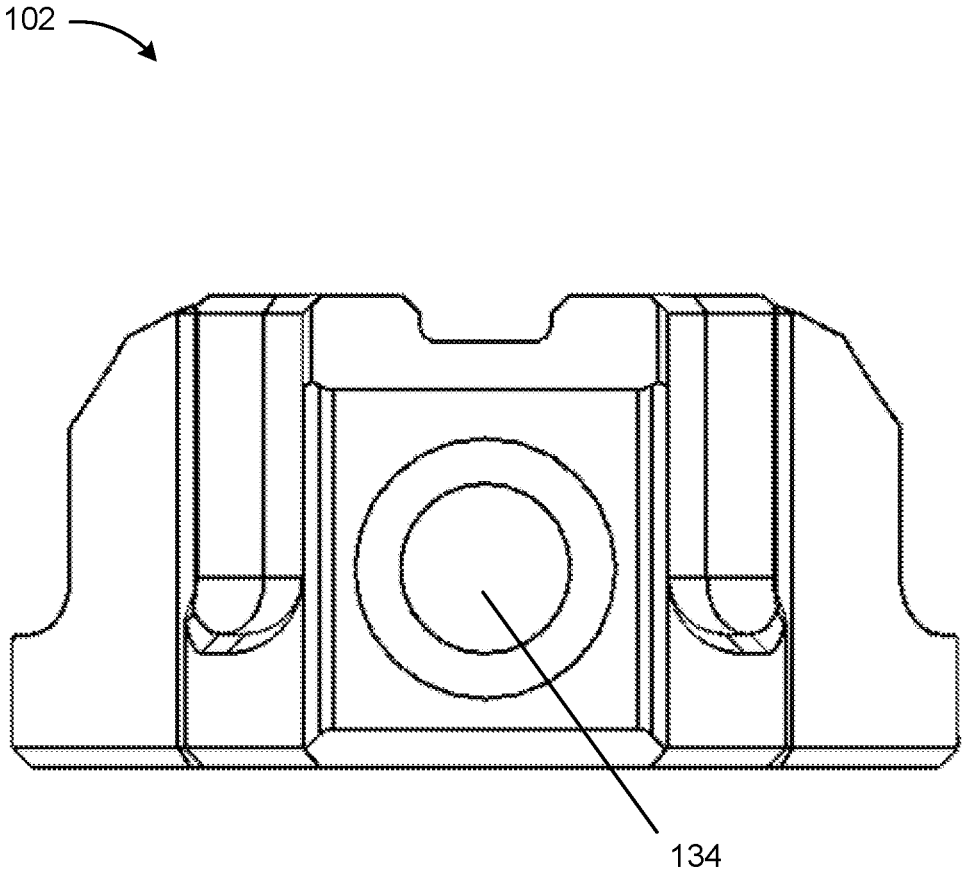
FIG. 3D is a front elevation view of the lever of the safety selector assembly according to one or more embodiments of the disclosure.
Figure 3E:
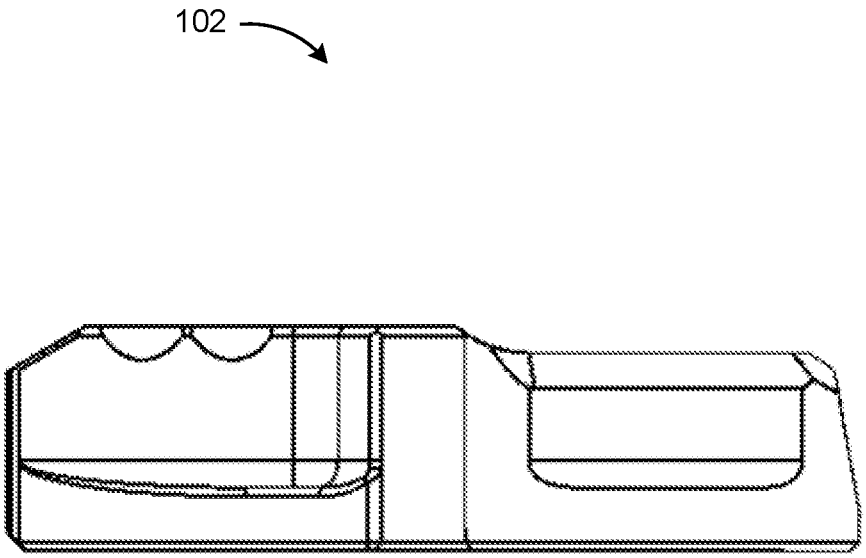
FIG. 3E is a side elevation view of the lever of the safety selector assembly according to one or more embodiments of the disclosure.
Figure 4:
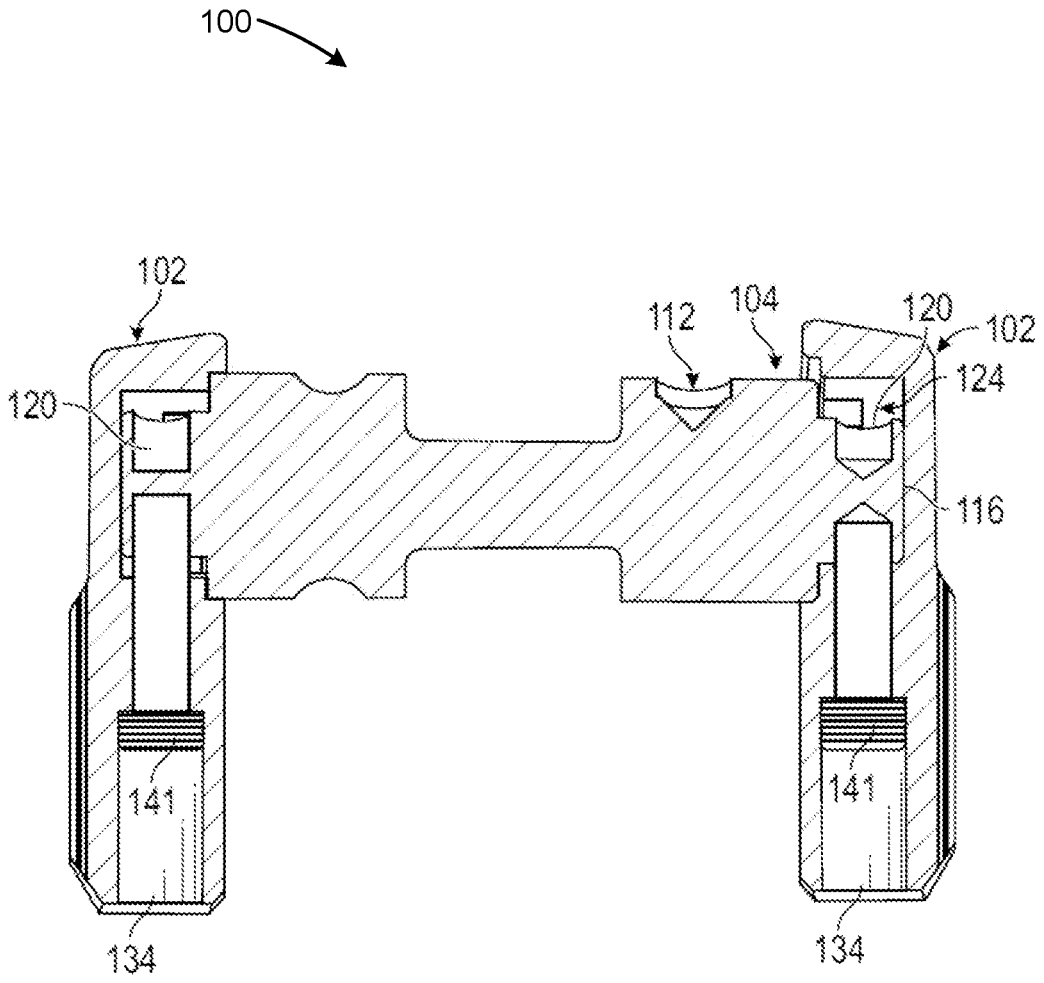
FIG. 4 is a side cross-sectional view of the safety selector assembly according to one or more embodiments of the disclosure.

The lever handle 130 can extend from the lever head 132. In certain embodiments, the leer handle 130 and lever head 132 are integrally formed as a single piece. In some examples, the lever handle 130 includes a lever aperture 134 extending from the socket 124 inside the lever head 132 to a distal end 148 (e.g., as shown in FIG. 3B) of the lever handle 130. As shown in FIG. 4, once the lever 102 is secured onto the post 116, a detent 141 can be secured within the lever aperture 134 and the post detent slot 120. The detent 141 can be a screw. In other examples, the detent may be a pin or other securing mechanism.

FIG. 4 depicts a cross-sectional view of the safety selector assembly 100. Now referring to FIGS. 1A-4, the safety selector assembly 100 includes the two levers 102 connected to the core member 104 via the respective posts 116. As shown, the posts 116 can include at least two post detent slots 120 on each post. The levers 102 can be rotated with respect to the core member 104 to align the lever aperture 134 with either post detent slot 120. In certain examples, once the lever aperture 134 is aligned with the post detent slot 120, the detent 141 can be screwed into the lever aperture 134 and post detent slot 120, thereby securing the lever 102 and the core member 104. In some examples, the lever aperture 134 can be threaded. The optional rotation of the levers 102 with respect to the core member 104 and the respective post 116 allows each lever 102 to be placed into multiple different positions with respect to the core member 104 as well as providing a mechanism for changing the desired throw 112A, 112B to be used on the safety selector assembly 100. The optional rotation of the levers about the post 116 within the socket 124 to align with one or more of the post detent slots 120 allows customizing even when the core member 104 rests inside of the firearm receiver (not shown).

FIG. 6A depicts the safety selector assembly 100 in a first position 144. FIG. 6B depicts the safety selector assembly 100 in a second position 145. In some examples, the safety selector assembly 100 rotates adjacent to the trigger assembly 142 between the first position 144 (e.g., safety position) and the second position 145 (e.g., fire position). That is, the safety detent 149 engages the first throw 112A and can rotate (e.g., as shown by arrows adjacent to the lever 102) between the first throw slots. In one example, in the first position 144, the trigger assembly 142 abuts the fourth shelf surface 147 and is unable to rotate. A user can use either lever 102 to rotate the assembly 100 from the first position 144 to the second position 145. Further, in this example, in the second position 145, the shelf first surface 133 would be slightly removed from the trigger assembly 142, thereby allowing rotation of the trigger.

FIGS. 7A and 7B depict the safety selector assembly 100 in a third position 146 and a fourth position 147. In some examples, the safety selector assembly 100 rotates adjacent to the trigger assembly 142 between the third position 146 (e.g., safety position) and the fourth position 147 (e.g., fire position). That is, the safety detent 149 engages the second throw 112B and can rotate (e.g., as shown by arrows adjacent to the lever 102) between the first throw slots. In the third position 146, the trigger assembly 142 would abut the third shelf surface 137 and be unable to rotate. A user can use either lever 102 to rotate the assembly 100 from the third position 146 to the fourth position 147. In the fourth position 147, the shelf second surface 135 would be slightly removed from the trigger assembly 142 thereby allowing rotation of the trigger.

Although specific embodiments of the disclosure have been described, numerous other modifications and alternative embodiments are within the scope of the disclosure. For example, any of the functionality described with respect to a particular device or component may be performed by another device or component. Further, while specific device characteristics have been described, embodiments of the disclosure may relate to numerous other device characteristics. Further, although embodiments have been described in language specific to structural features and/or methodological acts, it is to be understood that the disclosure is not necessarily limited to the specific features or acts described. Rather, the specific features and acts are disclosed as illustrative forms of implementing the embodiments. Conditional language, such as, among others, "can," "could," "might," or "may," unless specifically stated otherwise, or otherwise understood within the context as used, is generally intended to convey that certain embodiments could include, while other embodiments may not include, certain features, elements, and/or steps. Thus, such conditional language is not generally intended to imply that features, elements, and/or steps are in any way required for one or more embodiments.

What is claimed is:

1. A safety selector assembly comprising:

a core member having a first end and a second end, the core member comprising:

a first post disposed along the first end of the core member;

at least one shelf recessed into the core member;

at least two throws disposed on the core member between the second end and the at least one shelf, the at least two throws comprising:

a first throw comprising a first throw slot, a second throw slot and a first angle created between the first throw slot and the second throw slot; and a second throw comprising a third throw slot, a fourth throw slot and a second angle created between the third throw slot and the fourth throw slot, wherein the first angle and the second angle are different; and a lever coupled to the first post.

2. The safety selector assembly of claim 1, wherein the first angle is substantially 50 degrees and the second angle is substantially 90 degrees.

3. The safety selector assembly of claim 1, wherein the first post comprises:

a base extending from the core member and comprising a free end and an outer surface;

at least one lip extending out from the outer surface of the base and disposed adjacent to the free end; and a post detent slot extending into the outer surface of the base and disposed adjacent to the at least one lip.

4. The safety selector assembly of claim 1, further comprising:

a second post disposed along the second end of the core member; and a second lever coupled to the second post.

5. The safety selector assembly of claim 1, wherein the core member further comprises:

a first raised portion disposed along the first end; and a second raised portion disposed along the second end;

wherein the at least one shelf is disposed between the first raised portion and the second raised portion and recessed with respect to the first raised portion and the second raised portion.

6. The safety selector assembly of claim 1, wherein the at least one shelf comprises:

a first shelf surface;

a second shelf surface;

a third shelf surface extending between the first shelf surface and the second shelf surface; and a fourth shelf surface extending between the first shelf surface and the second shelf surface, opposite to the third shelf surface.

7. The safety selector assembly of claim 1, wherein the lever comprises:

a lever head;

a lever handle extending from the lever head; and a socket disposed on the lever head;

wherein the socket receives the post.

8. The safety selector assembly of claim 7, wherein the lever further comprises:

an embedded recess within the lever head; and a lever aperture extending through the lever handle along a longitudinal axis of the lever handle.

9. The safety selector assembly of claim 1, wherein the lever is rotatably coupled to the first post.

10. A safety selector assembly comprising:

a core member having a first end and a distal second end;

at least one shelf recessed into the core member;

a first post disposed on the first end;

a second post disposed on the second end;

at least two throws disposed on the core member between the at least one shelf and the second end, the at least two throws comprising:

a first throw comprising a first throw slot, a second throw slot and a first angle created between the first throw slot and the second throw slot; and a second throw comprising a third throw slot, a fourth throw slot and a second angle created between the third throw slot and the fourth throw slot, wherein the first angle and the second angle are different; and a first lever coupled to the first post;

a second lever coupled to the second post, each of the first lever and the second lever comprising:

a lever head;

a lever handle extending from the lever head; and a socket disposed on the lever head;

wherein the socket receives one of the first post and the second post.

11. The safety selector assembly of claim 10, wherein the core member further comprises:

a groove adjacent to the first end.

12. The safety selector assembly of claim 11, wherein the shelf comprises:

a shelf first surface;

a shelf second surface; and a third surface extending between the shelf first surface and the shelf second surface, wherein the third surface is arcuate.

13. The safety selector assembly of claim 10, wherein the first angle is substantially 50 degrees and the second angle is substantially 90 degrees.

14. The safety selector assembly of claim 10, wherein the first post comprises:

a base extending from the core member and comprising a free end and an outer surface;

at least one lip extending out from the outer surface of the base and disposed adjacent to the free end; and a post detent slot extending into the outer surface of the base and disposed adjacent to the at least one lip.

15. The safety selector assembly of claim 10, wherein the lever further comprises:

an embedded recess within the lever head; and a lever aperture extending through the lever handle along a longitudinal axis of the lever handle.

16. The safety selector assembly of claim 10, wherein the lever is rotatably coupled to the first post.

* * * * *